US006187723B1

(12) United States Patent
Holt et al.

(10) Patent No.: US 6,187,723 B1
(45) Date of Patent: Feb. 13, 2001

(54) LUBRICANT COMPOSITION CONTAINING ANTIWEAR ADDITIVE COMBINATION

(75) Inventors: David Gary Lawton Holt, Wantage; Patrick Desmond Fraser Vernon, Littlemore; John Ian Atherton, Cassington, all of (GB)

(73) Assignee: Exxon Research and Engineering Company, Florham Park, NJ (US)

( * ) Notice: Under 35 U.S.C. 154(b), the term of this patent shall be extended for 380 days.

(21) Appl. No.: 08/990,052

(22) Filed: Dec. 12, 1997

Related U.S. Application Data

(63) Continuation-in-part of application No. 08/605,222, filed on Mar. 10, 1996, now abandoned.

(30) Foreign Application Priority Data

Sep. 9, 1994 (GB) ..... 9401971

(51) Int. Cl.[7] ..... C10M 137/10

(52) U.S. Cl. ..... 508/364; 508/365; 508/377; 508/378; 508/438; 508/440

(58) Field of Search ..... 508/438, 432, 508/364, 365, 377, 378, 440

(56) References Cited

U.S. PATENT DOCUMENTS

| | | | | |
|---|---|---|---|---|
| 2,565,920 | * | 8/1951 | Hook et al. | 508/431 |
| 2,586,655 | * | 2/1952 | Hook et al. | 508/431 |
| 2,961,457 | * | 11/1960 | Pohlemann et al. | 508/432 |
| 3,876,550 | * | 4/1975 | Holubec | 508/263 |
| 4,383,931 | * | 5/1983 | Ryu . | |
| 4,402,840 | * | 9/1983 | de Vries et al. | 508/362 |
| 4,474,673 | * | 10/1984 | Hunt et al. | 508/572 |
| 4,692,256 | * | 9/1987 | Umemura et al. | 508/362 |
| 4,758,362 | * | 7/1988 | Butke | 508/229 |
| 4,832,867 | * | 5/1989 | Seiki et al. | 508/364 |
| 4,966,719 | * | 10/1990 | Coyle et al. . | |

FOREIGN PATENT DOCUMENTS

| | | | |
|---|---|---|---|
| 205165 | * | 12/1986 | (EP) . |
| 316610 | * | 5/1989 | (EP) . |
| 369804 | * | 5/1990 | (EP) . |
| 393 768 | * | 10/1990 | (EP) . |
| 566326 | * | 10/1993 | (EP) . |
| 2255346 | * | 11/1992 | (GB) . |
| 86-04601 | * | 8/1986 | (WO) . |

OTHER PUBLICATIONS

JP, A, 06,080,981, Abstract Mar. 22, 1994.*
JP; A 54,113,604 Abstract Sep. 5, 1979.*

* cited by examiner

*Primary Examiner*—Margaret Medley
(74) *Attorney, Agent, or Firm*—Joseph J. Allocca

(57) ABSTRACT

A lubricant composition is described, particularly for engine oils, comprising a base oil of viscosity from 3 to 26 cSt ($mm^2/s$) at 100° C. and an antiwear additive combination comprising (a) an oil soluble or oil dispersible phosphorus-free organo-molybdenum compound, (b) an ashless, sulfur-containing organo-phosphorus compound, and optionally (c) a zinc thiophosphate compound selected from one or more of zinc dialkyldithiophosphate, zinc diaiyldithiophosphate, zinc alkylaiyldithiophosphate and zinc arylalkyldithiophosphate. The molybdenum compound may be a carbamate, e.g., MoDTC but is preferably nitrogen-free, e.g., a carboxylate.

14 Claims, No Drawings

LUBRICANT COMPOSITION CONTAINING ANTIWEAR ADDITIVE COMBINATION

This application is a continuation-in-part of U.S. Ser. No. 08/605,222 filed Mar. 10, 1996, now abandoned.

This invention relates to a lubricant composition containing a combination of additives providing antiwear properties, and to the antiwear additive combination contained therein.

It is well-known to include an antiwear additive in lubricating oils such as engine oils. Wear results mainly from the rubbing together of two metal surfaces, i.e., in boundary lubrication regimes, such as is found in valve trains in internal combustion engines. It is believed that the antiwear additive acts to provide a protective film over the metal surfaces. One well-known class of antiwear additives is the metal alkylphosphate, especially zinc dialkyldithiophosphate ("ZDDP"). Generally ZDDP is employed at treat levels of 1 to 2 wt % based on the total weight of the lubricant, which gives a phosphorus level in the lubricant typically in the range of from 0.05 to 0. 15 wt %, and a zinc level of from 0.1 to 0.2 wt %.

In recent years there has been increasing concern that lubricant ash levels, such as that produced by the zinc in ZDDP, contribute to particulate emissions from internal combustion engines. There is also concern that the phosphorus fiom the lubricant tends to poison catalysts used in catalytic converters, thereby preventing them fiom functioning to full effect. However, any reduction in ZDDP treat levels has the disadvantage that it will reduce the antiwear properties of the lubricant.

There is therefore a need for an effective antiwear additive with reduced zinc and phosphorus levels.

We have found that a phosphoius-free organo-molybdenum compound and an ashless sulfur-containing organo-phosphorus compound act together synergistically to provide improved antiwear performance when used in a lubricant composition. By using this combination of compounds it becomes possible to achieve the same or better performance than that achieved with ZDDP, with significantly lower levels of phosphorus.

Sulfur-containing organic phosphorus compounds are known to be used as "extreme pressure compounds" in heavy duty applications such as greases for constant velocity joints. It is also known to use sulfur-containing organic compounds of heavy metals such as molybdenum, tungsten and lead in such applications. Thus GB-A-2255346 describes an additive for grease used in constant velocity joints comprising in combination molybdenum sulfide dialkyldithiocarbamate, zinc dithiophosphate, a sulfur-phosphorus series extreme pressure compound, and lead dialkyldithiocarbamate. It is stated that the presence of the lead compound is essential to achieve the desired performance.

U.S. Pat. No. 4,648,985 describes a lead-free extreme pressure additive, generally for lubricants based on asphalt, utilizing an organic phosphate in combination with copper or molybdenum compounds selected from carboxylate, phosphate, thiophosphate and thiocarbamate, optionally with a metal-free thiocarbamate or in combination with a metal thiocarbamate (numerous metals being described). The preferred metals are copper and zinc.

Organic phosphorus compounds are also used as ashless dispersants. Thus EP-A-0516461 describes a dispersant additive for lubricating oils showing improved compatibility with elastomeric seal material which comprises in combination a metal dihydrocarbyl dithiocarbamate or dithiocarbamate and a phosphorylated ashless dispersant. Various metal compounds are described including molybdenum dithiophosphate.

EP-A-0316610 describes a multipurpose antiwear, anti-seizure and corrosion inhibiting additive for lubricating oils utilizing a combination of an organo-phosphorus compound selected from various phosphines and phosphites and an organo-molybdenum compound selected from oxysulphide alkylphosphorodithioates and oxysulphide alkyl dithiocarbamates.

GB-A-1373588 describes an antiwear, antioxidant additive combination comprising a metal dialkyldithiocarbamate and/or a metal alkyl, aryl or aralkyl dithiophosphate and a metal-free phosphorus compound selected from sulfurized sperm oil esterified with dithiophosphate, sulfurized terpene esterified with dithiophosphate, sulfurized and phosphated sperm oil and phosphorus polysulfide. Many metals are mentioned including molybdenum, zinc and lead.

In one aspect the present invention provides a lubricant composition comprising a base oil of viscosity from 3 to 26 cSt ($mm^2/s$) at 100° C. and an antiwear additive combination comprising (a) an oil soluble or oil-dispersible phosphorus-free organo-molybdenum compound wherein the organo group of the molybdenum compound is selected from carbamate, carboxylate and xanthate groups and mixtures thereof, and (b) an ashless, sulfur-containing organo phosphorus compound selected from:

(i) a phosphorothiolothionate of the formula:

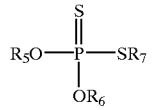

wherein $R_5$, $R_6$ and $R_7$ are each independently an unsubstituted branched or straight chain hydrocarbyl group or a branched or straight chain hydrocarbyl group substituted with one or more sulfur, oxygen, or nitrogen containing functional groups, (ii) a phosphorothionate of the formula:

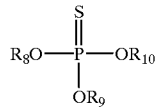

wherein $R_8$, $R_9$, and $R_{10}$ are as defined for $R_5$, $R_6$, and $R_7$ above; and (iii) a mixture of (i) and (ii).

Furthermore, we have found surprisingly that compounds (a), (b) when used in combination with reduced levels of a selected zinc thiophosphate, act synergistically to provide better wear protection than that achieved using a comparable amount (i.e., an amount providing a similar total level of phosphorus) of the zinc thiophosphate alone.

Accordingly in a preferred lubricant composition the combination includes, in addition to (a) and (b), a zinc thiophosphate compound (c) selected from one or more of zinc dialkyldithiophosphate, zinc diaryldithiophosphate, zinc alkylaryldithiophosphate and zinc arylalkyldithiophosphate.

This provides the advantage that the organo-molybdenum compound can replace some of the zinc thiophosphate compound used in lubricant compositions with the effect that the phosphorus level in the lubricant is reduced without substantially reducing, indeed increasing the antiwear performance of the lubricant.

The organo-molybdenum compound may comprise a molybdenum carbamate, preferably a dicarbamate and more preferably a dithiocarbamate (MoDTC) the organo group(s) of which may be substituted with hydrocarbyl groups, with the proviso that the organo group selected results in an organo-molybdenum compound that is oil-soluble or oil-dispersible, preferably oil-soluble.

However it is known that MoDTC decomposes when heated in use to decomposition products which include free amine and carbon disulfide. Both such products are aggressive towards copper, which is present in the engine bearings. Wear in bearings is particularly objectionable since repair involves complete dismantling of the engine. Carbon disulfide tends to boil off fairly rapidly and does not constitute a special problem. However even small amounts of free amine can cause damage.

We have found that the synergisms described above extend not only to carbamates of molybdenum but also to molybdenum compounds which are nitrogen free and which therefore do not decompose to free amine. Organo-molybdenum compound which are also free from sulfur are also known.

Accordingly, while from a performance perspective, in a preferred combination of (a) and (b) together optionally with (c) the organo-molybdenum compound is a carbamate, in those situations wherein it is desirable to have an oil with low sulfur and/or nitrogen content, then organo-molybdenum compounds that are sulfur and/or nitrogen-free, e.g., carboxylate and xanthate or mixtures thereof, the organo group(s) of which may be substituted with a hydrocarbyl group, are preferred, again with the proviso that the organo group selected results in an organo-molybdenum compound that is oil-soluble or oil-dispersable, preferably oil-soluble.

While the preferred organo-molybdenum compound from a performance viewpoint is carbamate, those compounds which do not contain sulfur and/or nitrogen or phosphorus have an advantage in that they are relatively cheap and contain a higher proportion of molybdenum than the more complex compounds. As will be described in more detail, it is believed that the effective additive content is governed by the metal content. Thus only about one third of the amount of, e.g., molybdenum 2-ethyl hexanoate, need be used as compared with molybdenum dithiocarbamate.

In another aspect the present invention provides an antiwear agent comprising a combination of (a) an organo-molybdenum compound as above described, (b) an ashless organo-phosphorus compound as above described and, optionally, (c) a zinc thiophosphate as above described.

In a further aspect the present invention provides the use in a lubricant composition of the combination of (a) an organo-molybdenum compound as above described, (b) an ashless organo-phosphorus compound as above described and, optionally, (c) a zinc thiophosphate as above described, as an antiwear agent.

In a yet further aspect the invention provides an additive concentrate comprising in combination: (a) an organo-molybdenum compound as above described, (b) an ashless organo-phosphorus compound as above described, optionally (c) a zinc thiophosphate as above described and a carrier fluid.

Where the organo group is a carbamate, the organo-molybdenum compound is preferably a molybdenum dithiocarbamate of the formula:

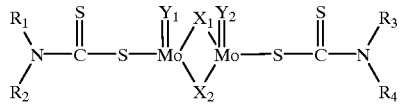

where $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or aralkyl group, or a $C_3$ to $C_{20}$ hydrocaibyl group containing an ester, ether, alcohol or carboxyl group; and $X_1$, $X_2$, $Y_1$ and $Y_2$ each independently represent a sulfur or oxygen atom.

Examples of suitable groups for each of $R_1$, $R_2$, $R_3$ and $R_4$ include 2-ethylhexyl, nonylphenyl, methyl, ethyl, n-propyl, iso-propyl, n-butyl, t-butyl, n-hexyl, n-octyl, nonyl, decyl, dodecyl, tridecyl, lauryl, oleyl, linoleyl, cyclohexyl and phenylmethyl. Preferably $R_1$ to $R_4$ are each $C_6$ to $C_{18}$ alkyl groups, more preferably $C_{10}$ to $C_{14}$.

It is preferred that $X_1$ and $X_2$ are the same, and $Y_1$ and $Y_2$ are the same. Most preferably $X_1$ and $X_2$ are both sulfur atoms, and $Y_1$ and $Y_2$ are both oxygen atoms.

Thus in a preferred embodiment the organo-molybdenum compound is sulfurized oxymolybdenum dithiocarbamate wherein the thiocarbamate groups contain $C_{10}$ to $C_{14}$ alkyl groups. Such compounds are commercially available and are supplied, for example, by R. T. Vanderbilt Company.

Where the organo group of the organo-molybdenum compound is a carboxylate, this is preferably a $C_1$ to $C_{50}$, more preferably a $C_6$ to $C_{18}$, carboxylate group. Examples of suitable carboxylates include octoate, e.g., 2-ethyl hexanoate, naphthenate and stearate. These compounds may be prepared, for example, by reacting molybdenum trioxide with the alkali metal salt of the appropriate carboxylic acid under suitable conditions.

Where the organo group of the organo-molybdenum compound is a xanthate, the compound preferably has the formula:

$$Mo_2(ROCS_2)_4 \qquad \text{(II)}$$

where R is a $C_1$ to $C_{30}$ hydrocarbyl group, preferably an alkyl group. Examples of suitable molybdenum xanthate compounds and their method of preparation are described in European patent application EP-A-433025, the disclosure of which is incorporated herein by reference.

The ashless organo-phosphorus compound is selected from a phosphorothiolothionate, a phosphorothionate and mixtures thereof.

Phosphorothiolothionates have the general formula:

(III)

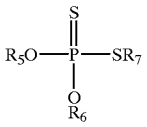

where $R_5$, $R_6$ and $R_7$ each independently represent a hydrocarbyl group which may be substituted with one or more sulfur, oxygen or nitrogen containing functional groups, or may be unsubstituted, and which may be branched or straight-chain.

Preferably $R_5$ and $R_6$ are each a $C_1$ to $C_{30}$ alkyl group, or a $C_6$ to $C_{30}$ cycloalkyl, aryl, aralkyl or alkylaryl group. $R_7$ is preferably a $C_1$ to $C_{30}$ alkyl group, a $C_6$ to $C_{30}$ cycloalkyl, aryl, aralkyl or alkylaryl group, or a $C_1$ to $C_{30}$ hydrocarbyl group containing one or more carboxylic acid, ester, alcohol, ether, thio ester, thio ether, thio acid (—COSH), thio alcohol, or amine groups, or an ammonium ion, preferably one or more carboxylic acid groups. Examples of suitable phosphorothiolothionates which are commercially available include VANLUBE 727, VANLUBE 7611 both supplied by R. T. Vanderbilt Company, IRGALUBE 63 supplied by Ciba-Geigy, and ECA 6330 supplied by Exxon Chemical Company.

Phosphorothionates have the general formula:

(IV)

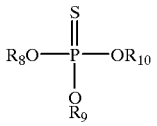

where $R_8$, $R_9$, and $R_{10}$ each represent a hydrocarbyl group which may be substituted with one or more sulfur, oxygen or nitrogen containing functional groups, or may be unsubstituted, and which may be branched or straight-chain.

Preferably $R_8$ and $R_9$ are each a $C_1$ to $C_{30}$ alkyl group or a $C_6$ to $C_{30}$ cycloalkyl, aryl, aralkyl or alkylaryl group. $R_{10}$ is preferably a $C_1$ to $C_{30}$ alkyl group or a $C_6$ to $C_{30}$ cycloalkyl, aryl, aralkyl or alkylaryl group, or a $C_1$ to $C_{30}$ hydrocarbyl group containing one or more amine, carboxylic acid, ester, alcohol or ether groups, thio ester, thio ether, thio acid (—COSH), thio alcohol, or an ammonium ion, preferably an amine group or ammonium ion. Examples of suitable phosphorothionates which are commercially available include IRGALUBE TPPT supplied by Ciba-Geigy. Phosphorus thionates may also be obtained fiom the reaction of amines with dialkyldithiophosphoric acids.

The zinc thiophosphate compound (c) has the general formula:

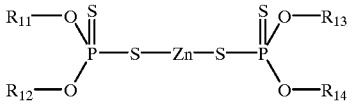

where $R_{11}$, $R_{12}$, $R_{13}$ and $R_{14}$ each independently represent a hydrogen atom, a $C_1$ to $C_{20}$ alkyl group, a $C_6$ to $C_{26}$ cycloalkyl, aryl, alkylaryl or aralkyl group, or a $C_3$ to $C_{20}$ hydrocarbyl group containing an ester, ether, alcohol or carboxyl group. Preferably each of $R_{11}$ to $R_{14}$ is a $C_2$ to $C_{18}$, more preferably $C_3$ to $C_8$, alkyl group which may be straight-chain or branched. Such compounds are commercially available and are supplied by, for example, Exxon Chemical Company.

The amounts of each of the antiwear additives (a) and (b) to be included in the lubricant composition according to the invention are the amounts that are effective in providing the desired level of antiwear performance, whilst reducing the amount of phosphorus to an acceptable level.

Whilst not being limited to any particular theory, it is believed that the antiwear properties of the organo-molybdenum compound (a) are generally attributable to the presence of the molybdenum. Thus when determining the amount of organo-molybdenum compound to be incorporated into the lubricant composition, one first needs to determine the desired amount of molybdenum. Preferably the amount of molybdenum contained in the lubricant composition is from 0.001 to 0.5 wt %, more preferably 0.005 to 0.2 wt %, and most preferably 0.01 to 0.05 wt %, based on the total weight of the lubricant composition. The amount of organo-molybdenum compound that this corresponds to depends upon the type of compound selected.

Where the organo-molybdenum compound is a dithiocarbamate, the amount of compound used depends on the molecular weight of the R groups contained in the thiocarbamate groups, as defined in formula (I) above. Typically, however, the amount of molybdenum dithiocarbamate used is preferably from 0.01 to 3.0 wt %, more preferably fiom 0.02 to 2.0 wt %, and most preferably from 0.05 to 1.0 wt %, based on the total weight of the lubricant composition.

Where the organo-molybdenum compound is a carboxylate, the amount of compound used depends upon the molecular weight of the carboxylate group selected. For example, where the carboxylate is 2-ethyl hexanoate, the amount of molybdenum carboxylate used is preferably from 0.005 to 2.5 wt %, more preferably from 0.025 to 1.0 wt %, and most preferably from 0.05 to 0.25 wt %, based on the total weight of the lubricant composition.

Where the organo-molybdenum compound is a xanthate, the amount of compound used depends upon the molecular weight of the hydrocarbyl, e.g. alkyl, groups contained in the xanthate groups. Typically, however, the amount of molybdenum xanthate used is preferably from 0.003 to 2.0 wt %, more preferably from 0.01 to 0.7 wt % and most preferably from 0.03 to 0.2 wt %, based on the total weight of the lubricant composition.

Similarly, it is believed that the antiwear properties of the ashless organo-phosphorus compound (b) and the zinc thiophosphate, when used, are generally attributable to the presence of the phosphorus. Thus, when determining the amounts of these compounds to incorporate, one first needs to determine the desired amount of phosphorus in the lubricant composition. Preferably the total amount of phosphorus contained in the lubricant composition is from 0.001 to 0.3 wt %, more preferably from 0.01 to 0.2 wt %, and most preferably from 0.02 to 0.1 wt %, based on the total weight of the lubricant composition.

The amount of ashless organo-phosphorus compound and zinc thiophosphate compound (when used) that this corresponds to depends on the relative proportions of these compounds and the molecular weights of the particular compounds selected. Typically, however, the amount of ashless organo-phosphorus compound incorporated into the lubricant composition is preferably from 0.01 to 3.0 wt %, more preferably from 0.1 to 2.0 wt %, and most preferably from 0.2 to 1.0 wt %, based on the total weight of the lubricant composition, and the amount of zinc thiophosphate compound is preferably from 0.01 to 3.0 wt %, more preferably 0.1 to 2.0 wt %, and most preferably 0.2 to 1.0 wt % based on the total weight of the lubricant composition.

The ratio of organo-molybdenum compound (a) to ashless organo-phosphorus compound (b) is preferably such that the weight ratio of molybdenum to phosphorus in the lubricant composition, due to the presence of compounds (a) and (b), is from 1:50 to 100:1, more preferably from 1:10 to 20:1, and most preferably from 1:1 to 10:1. The weight ratio of phosphorus derived from the ashless organo-phosphorus compound (b) to zinc thiophosphate compound (c) (when used) is preferably from 10:1 to 1:20, more preferably from 5:1 to 1:15 and most preferably 1:1 to 1:10.

The base oil employed in the lubricant composition according to the invention may be any base oil having a viscosity suitable for use of the lubricant in an engine, e.g., as a crankcase oil or gear oil. Thus the base oil may be, for example, a conventionally refined mineral oil, an oil derived from coal tar or shale, a vegetable oil, an animal oil, a hydrocracked oil, or a synthetic oil, or a mixture of two or more of these types of oils. Examples of synthetic oils include hydroisomerized paraffins, polyalphaolefins, polybutene, alkylbenzenes, poly-glycols, esters such as polyol esters or dibasic carboxylic acid esters, alkylene oxide polymers, and silicone oils. The viscosity of the base oil depends upon the intended use, but generally is in the range of from 3 to 26 cSt ($mm^2/s$)at 100° C., preferably from 3 to 20 cSt ($mm^2/s$)at 100° C.

The antiwear additive compounds (a) and (b), and (c) when used, may be mixed directly with the base oil, but, for ease of handling and introduction of the compounds to the base oil, are preferably in the form of additive concentrate comprising the additive compound, or mixture of both compounds, contained in a carrier fluid. The carrier fluid is typically an oil and may be, for example, any of the oils mentioned above in the description of the base oil. Alternatively, it may be an organic solvent, for example naphtha, benzene, toluene, xylene and the like. The carrier fluid should be compatible with the base oil of the lubricant composition, but otherwise is preferably ineit. Generally the concentrate will comprise from 10 to 90 wt % of the additive(s), preferably from 30 to 70 wt %, the balance being the carrier fluid.

The lubricant composition according to the invention may also contain other additives, which may be added directly to the base oil, as a separate additive concentrate, or included in the concentrate of the antiwear additives. For example, where the lubricant is an engine oil, other additives that may be incorporated include one or more of a detergent, dispersant, antioxidant, corrosion inhibitor, extreme pressure agent, antifoaming agent, pour point depressant and viscosity index improver. Such additives are well-known and the selection of appropriate additives could readily be determined by a person skilled in the art of lubricant formulating.

The lubricant composition may find use in any application where the parts to be lubricated are subject to wear. It is especially suitable for use as an engine oil for internal combustion engines.

The invention is illustrated by the following Examples.

EXAMPLES 1 to 3

A number of engine oils were formulated by blending an organo-molybdenum compound and an ashless organo-phosphorus compound with a conventional engine oil formulation (the "basecase" oil) which was based on a conventionally refined mineral oil and contained standard engine oil additives except that ZDDP was omitted. For comparative purposes, further engine oils were formulated omitting one or more of the antiwear additives, and, in one example, ZDDP was added.

The formulations are listed in Table 1 below.

The organo-molybdenum compounds used were: (i) MOLYVAN 822 (trade name) a molybdenum dithiocarbamate supplied by R. T. Vanderbilt Company, (ii) MOLYNAPALL (trade name), a molybdenum naphthenate supplied by Mooney Chemicals, and (iii) MOLYHEXCEM (trade name), molybdenum 2-ethyl hexanoate supplied by Mooney Chemicals. The molybdenum content of each of these compounds was determined using ICP (inductively-coupled plasma) analysis.

The ashless organo-phosphorus compounds used were: (i) IRGALUBE TPPT (trade name), a phosphorothionate supplied by Ciba-Geigy, (ii) VANLUBE 727 (trade name), a phosphorothiolothionate supplied by R. T. Vanderbilt Company, and (iii) "Amine DDP", an amine derivative of a phosphorothionate obtained by reacting the amine PRIMENE JMT (trade name) supplied by Rohm and Haas with dioctyldithiophosphoric acid. The phosphorus content of each of these compounds was determined using X-ray fluorescent analysis according to standard test AMS 86.002.

The ZDDP compound used was PARANOX 14 supplied by Exxon Chemical Company. The phosphorus content of this compound was also determined using the above X-ray fluorescent analysis technique.

The resulting engine oils were tested for valve train wear by measuring camshaft wear and tappet scuffing using a motored cylinder head test rig which is equivalent to the industry standard TU-3 engine test CEC L-38-T-87, which test procedure is available from the CEC Secretariat, 61 New Cavendish Street, London W1 8AB.

The results are given in Table 1 below. All percentages are by weight based on the weight of the fully formulated engine oil.

In Table 1 the following abbreviations are used:

| | |
|---|---|
| PN 14 = | PARANOX 14 |
| MV 822 = | MOLYVAN 822 |
| M.N.ALL = | MOLYNAPALL |
| M.H.CEM = | MOLYHEXCEM |
| I.TPPT = | IRGALUBE TPPT |
| VL 727 = | VANLUBE 727 |
| P.JMT = | PRIMENE JMT reacted with dioctyldithiophosphoric acid |

Good results are indicated by a low value for camshaft wear and a high value for tappet scuffing. From the results it can be seen that addition of an organo-molybdenum compound as the sole antiwear additive produces only a small improvement in camshaft wear and some improvement in tappet scuffing over the basecase oil containing no antiwear additive. Likewise addition of solely an organo-phosphorus compound produces some improvement in camshaft wear and tappet scuffing. However addition of both compounds produces significant antiwear improvement. Furthermore the improvement achieved is greater than that achieved using ZDDP, even when the total active ingredient is higher for the ZDDP-containing formulation (Example 1A) than the formulation according to the invention (Example 1D). Furthermore, better results than with ZDDP alone were achieved when the organo-molybdenum compound was 2-ethyl hexanoate (Example 3E) the results being only marginally less than with dithiocarbomate (Example 3C)and was achieved using only 0.07 wt % of the additive compound as against 0.2 wt % in the case of dithiocarbamate.

TABLE 1

| Example | Invention/ Comparison | Basecase Oil | ZDDP | Organo-Mo | Organo-P | % Mo | % P | % Total Active Ingredient | Camshaft Wear (μm) | Tappet Scuffing (Merit) |
|---|---|---|---|---|---|---|---|---|---|---|
| 1A | C | I | 1.2% PN 14 | — | — | — | 0.1 | 0.1 | 7.25 | 4.5 |
| 1B | C | I | — | 0.2% MV 822 | — | 0.01 | — | 0.01 | 11.12 | 5.0 |
| 1C | C | I | — | — | 0.56% I.TPPT | — | 0.05 | 0.05 | 6.25 | 5.6 |
| 1D | I | I | — | 0.2% MV 822 | 0.56% I.TPPT | 0.01 | 0.05 | 0.06 | 4.0 | 7.9 |
| 2A | C | II | — | — | — | — | — | — | 36.9 | 5.0 |
| 2B | C | II | — | 1.0% MV 822 | — | 0.05 | — | 0.05 | 32.6 | 5.6 |
| 2C | C | II | — | — | 0.5% VL 727 | — | 0.03 | 0.03 | 9.25 | 5.3 |
| 2D | I | II | — | 0.2% MV 822 | 0.5% VL 727 | 0.01 | 0.03 | 0.04 | 4.1 | 7.7 |
| 3A | C | III | — | 0.2% MV 822 | — | 0.01 | — | 0.01 | 23.6 | 5.0 |
| 3B | C | III | — | — | 1.19% P.JMT | — | 0.05 | 0.05 | 13.13 | 6.9 |
| 3C | I | III | — | 0.2% MV 822 | 1.19% P.JMT | 0.01 | 0.05 | 0.06 | 4.38 | 7.9 |
| 3D | I | III | — | 0.17% M.N.ALL | 1.19% P.JMT | 0.01 | 0.05 | 0.06 | 8.38 | 7.2 |
| 3E | I | III | — | 0.07% M.H.CEM | 1.19% P.JMT | 0.01 | 0.05 | 0.06 | 6.75 | 7.5 |

EXAMPLE 4

An engine oil was formulated by adding the following antiwear additives to a basecase oil consisting of conventional engine oil based on a conventionally refined mineral oil and containing standard engine oil additives other than ZDDP:

(a) 0.2 wt % MOLYVAN 822 (molybdenum dithiocarbamate as in Example 1);

(b) 0.8 wt % ECA 6330, a phosphorothiolothionate supplied by Exxon Chemical Company; and (c) 1.0 wt % PARANOX 14 (ZDDP as in Example 1).

The amount of molybdenum contained in (a) was determined using ICP (inductively-coupled plasma) analysis. The amount of phosphorus contained in each of (b) and (c) was determined using X-ray fluorescent analysis according to standard test AMS 86.002.

Comparative engine oils were formulated using the same basecase oil and omitting one or more of the above antiwear additives (a), (b) and (c).

The resulting engine oils were tested for valve train wear by measuring tappet wear according to the standard industry engine test VW 5106 Cam and Tappet Test (procedure P-VW 5106), which test procedure is available from VW AG, Postfach 3180, Wolfsburg 1, Germany.

The resulting engine oils were tested for valve train wear by measuring tappet wear according to the standard industry engine test VW 5106 Cam and Tappet Rig.

The results are given in Table 2 below. All percentages are by weight based on the weight of the fully formulated engine oil.

| Example | Organo-Mo | Ashless-P | ZDDP | % Mo | % P | % Total Active Ingredient | Maximum Tappet Wear (μm) |
|---|---|---|---|---|---|---|---|
| 4A | 0.2% | 0.8% | 1.0% | 0.01 | 0.10 | 0.11 | 100 |
| 4B | — | — | 1.2% | — | 0.10 | 0.10 | 123 |
| 4C | 0.2% | — | 1.0% | 0.01 | 0.09 | 0.10 | 127 |
| 4D | — | 0.8% | 1.0% | — | 0.10 | 0.10 | 123 |

The lower the tappet wear value the better the antiwear performance of the lubricant. Thus the results show that for the same level of total phosphorus a significant improvement in antiwear performance is achieved when the antiwear agent is a combination of organo-molybdenum compound, ashless organo-phosphorus compound and ZDDP.

What is claimed is:

1. An antiwear additive combination for use in a lubricant composition comprising:

(a) an oil soluble or oil dispersible phosphorus-free organo-molybdenum compound selected from the group consisting of (I) molybdenum dithiocarbamate of the formula:

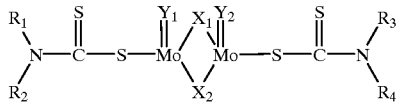

wherein $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or aralkyl group or a $C_3$–$C_{20}$ hydrocarbyl group containing an ester, ether, alcohol or carboxyl group and $X_1$, $X_2$, $Y_1$, and $Y_2$ each independently represent a sulfur or oxygen atom;

(II) molybdenum carboxylate containing a $C_1$ to $C_{50}$ carboxylate group;

(III) molybdenum xanthate of the formula:

$$Mo_2(ROCS_2)_4$$

wherein R is a $C_1$ to $C_{30}$ hydrocarbyl group, and mixtuires thereof, and (b) an ashless, sulfur-containing organo phosphorus compound selected from:

(i) a phosphorothiolothionate of the formula

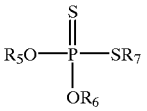

wherein $R_5$, $R_6$ and $R_7$ are each independently an unsubstituted branched or straight-chain hydrocarbyl group, or a substituted branched or straight chain hydrocarbyl group wherein the substitutents are selected from the group consisting of sulfur, oxygen or nitrogen containing functional group;

(ii) a phosphorothionate of the formula:

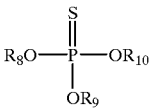

wherein $R_8$, $R_9$, and $R_{10}$ are as defined for $R_5$, $R_6$, and $R_7$ above; and (iii) a mixture of (i) and (ii); and (c) optionally, a zinc thiophosphate compound of the formula:

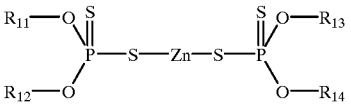

wherein $R_{11}$, $R_{12}$, $R_{13}$, and $R_{14}$ are each independently a hydrogen atom, a $C_1$ to $C_{20}$ alkyl group, a $C_6$ to $C_{26}$ cycloalkyl, aryl, alkyl aryl or aralkyl group, or a $C_3$ to $C_{20}$ hydrocarbyl group containing an ester, ether, alcohol or carboxyl group.

2. The antiwear additive combination of claim 1 wherein $R_5$ and $R_6$ of the phosphorothiolothionate and $R_8$ and $R_9$ of the phosphorothionate are each a $C_1$ to $C_{30}$ alkyl group or a $C_6$ to $C_{30}$ cyclo alkyl, aryl, aralkyl and alkylaryl group and $R_7$ of the phosphorothiolothionate and $R_{10}$ of the phosphorothionate are each selected from the group consisting of $C_1$ to $C_{30}$ alkyl group, $C_6$ to $C_{30}$ cycloalkyl, aryl, aralkyl and alkylaryl group and $C_1$ to $C_{30}$ hydrocarbyl group containing one or more carboxylic acid, ester, ether, alcohol, amine, thioester, thioether, thio acid, thio alcohol group or an ammonium ion.

3. An additive concentrate comprising a carrier fluid, compatible with base oil, in which fluid the additive combination of claim 1 or 2 is dispersed and/or dissolved.

4. A lubricant composition comprising a base oil of viscosity of from 3 to 26 $mm^2/s$ at 100° C., and an anti wear additive combination according to claim 1 or 2.

5. The lubricant composition according to claim 4 wherein the amount of organo-molybdenum compound contained in the lubricant composition is such that the amount of molybdenum contained in the lubricant composition is from 0.001 to 0.5 wt %, based on the total weight of the lubricant composition and wherein the amount of ashless organo-phosphorus compound contained in the lubricant composition is such that the amount of phosphorus contained in the lubricant composition is form 0.001 to 0.3 wt %, based on the total weight of the lubricant composition.

6. The lubricant composition according to claim 4 wherein the ratio of organo-molybdenum compound to the ashless organo-phosphorus compound in the lubricant composition is such that the weight ratio of molybdenum to phosphorus in the lubricant composition is from 1:50 to 100:1.

7. The lubricant composition according to claim 4 wherein the amount of zinc thiophosphate compound and ashless organo-phosphorus compound contained in the lubricant composition is such that the amount of phosphorus contained in the lubricant composition is from 0.001 to 0.3 wt %, based on the total weight of the lubricant composition and wherein the ratio of organo-molybdenum compound to the ashless organo-phosphorus and zinc thiophosphate compounds in the lubricant composition is such that the weight ratio of molybdenum to phosphorus in the lubricant composition is from 1:50 to 100:1.

8. The lubricant composition according to claim 4 wherein the weight ratio of phosphorus derived from the ashless organo-phosphorus compound to phosphorus derived from the zinc thiophosphate compound is from 10:1 to 1:20.

9. The lubricant composition according to claim 5 wherein the ratio of organomolybdenum compound to the ashless organo-phosphorus compound in the lubricant composition is such that the weight ratio of molybdenum to phosphorus in the lubricant composition is form 1:50 to 100:1.

10. The lubricant composition according to claim 5 wherein the amount of zinc thiophosphate compound and ashless organo-phosphorus compound contained in the lubricant composition is such that the amount of phosphorus contained in the lubricant composition is from 0.001 to 0.3 wt %, based on the total weight of the lubricant composition and wherein the ratio of organo-molybdenum compound to the ashless organo-phosphorus and zinc thiophosphate compounds in the lubricant composition is such that the weight ratio of molybdenum to phosphorus in the lubricant composition is from 1:50 to 100:1.

11. A lubricant composition according to claim 8 wherein the amount of zinc thiophosphate compound and ashless organo-phosphorus compound contained in the lubricant composition is such that the amount of phosphorus contained in the lubricant composition is from 0.001 to 0.3 wt %, based on the total weight of the lubricant composition and wherein the ratio of organo-molybdenum compound to the ashless organo-phosphorus and zinc thiophosphate compounds in the lubricant composition is such that the weight ratio of molybdenum to phosphorus in the lubricant composition is from 1:50 to 100:1.

12. A method for improving the antiwear performance of a lubricating oil composition by adding to the lubricating oil composition an antiwear additive mixture comprising:

(a) an oil soluble or oil dispersible phosphorus-free organo-molybdenum compound selected from the group consisting of (I) molybdenum dithiocarbamate of the formula:

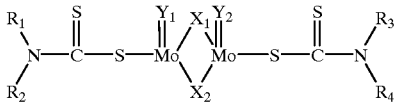

wherein $R_1$, $R_2$, $R_3$ and $R_4$ each independently represent a hydrogen atom, a $C_1$ to $C_{20}$ alkyl group, a $C_6$ to $C_{20}$ cycloalkyl, aryl, alkylaryl or aralkyl group or a $C_3$-$C_{20}$ hydrocarbyl group containing an ester, ether, alcohol or carboxyl group and $X_1$, $X_2$, $Y_1$ and $Y_2$ each independently represent a sulfur or oxygen atom;

(II) molybdenum carboxylate containing a $C_1$ to $C_{50}$ carboxylate group;

(III) molybdenum xanthate of the formula:

$$Mo_2(ROCS_2)_4$$

wherein R is a $C_1$ to $C_{30}$ hydrocarbyl group, and mixtures thereof, and (b) an ashless, sulfur-containing organo phosphorus compound selected from:

(i) a phosphorothiolothionate of the formula

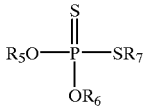

wherein $R_5$ and $R_6$ are each a $C_1$ to $C_{30}$ alkyl group, or a $C_6$ to $C_{30}$ cycloalkyl, aryl, aralkyl or alkylaryl group, and $R_7$ is a $C_1$ to $C_{30}$ alkyl group, a $C_6$ to $C_{30}$ cycloalkyl, aryl, aralkyl or alkyl aryl group or a $C_1$ to $C_{30}$ hydrocarbyl group containing one or more carboxylic acid, ester, alcohol, ether, thioester, thio ether, thio acid, thio alcohol or amine groups or an ammonium ion;

(ii) a phosphorothionate of the formula:

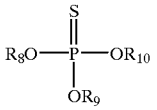

wherein $R_8$ and $R_9$ are as defined for $R_5$ and $R_6$ above and $R_{10}$ is as defined for $R_7$ above; and (iii) a mixture of (i) and (ii), and (c) optionally, a zinc thiophosphate compound of the formula:

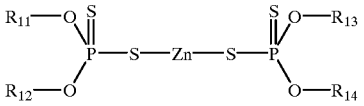

wherein $R_1$, $R_{12}$, $R_{13}$, and $R_{14}$ are each independently a hydrogen atom, a $C_1$ to $C_{20}$ alkyl group, a $C_6$ to $C_{26}$ cycloalkyl, aryl, alkyl aryl or aralkyl group, or a $C_3$ to $C_{20}$ hydrocarbyl group containing an ester, ether, alcohol or carboxyl group.

13. The method according to claim 12 wherein the amount of zinc thiophosphate compound and ashless organo-phosphorus compound added to the lubricant composition is such that the amount of phosphorus contained in the lubricant composition is form 0.001 to 0.3 wt %, based on the total weight of the lubricant composition and/or wherein the ratio of organomolybdenum compound to the ashless organo-phosphorus and zinc thiophosphate compounds added to the lubricant composition is such that the weight ratio of molybdenum to phosphorus in the lubricant composition is from 1:50 to 100:1.

14. The method of claim 12 wherein the weight ratio of phosphorus derived from the ashless organo-phosphoric compound to phosphorus derived from the zinc thiophosphate compound is fiom 10:1 to 1:20.

* * * * *